US006465765B2

(12) United States Patent
Katayama et al.

(10) Patent No.: US 6,465,765 B2
(45) Date of Patent: Oct. 15, 2002

(54) FLUID HEATING APPARATUS

(75) Inventors: Masakazu Katayama, Kyoto (JP); Seiji Oku, Kyoto (JP); Tomonori Kojimaru, Kyoto (JP); Yusuke Muraoka, Kyoto (JP)

(73) Assignees: Omron Corporation (JP); Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 09/782,848

(22) Filed: Feb. 14, 2001

(65) Prior Publication Data

US 2001/0017296 A1 Aug. 30, 2001

(30) Foreign Application Priority Data

Feb. 24, 2000 (JP) ..... 2000-047387

(51) Int. Cl.[7] ..... H05B 6/06
(52) U.S. Cl. ..... 219/630; 219/629; 219/667
(58) Field of Search ..... 219/629, 630, 219/628, 631, 667, 672, 674

(56) References Cited

U.S. PATENT DOCUMENTS 4,560,849 A * 12/1985 Migliori et al. ..... 219/667
5,350,901 A * 9/1994 Iguchi et al. ..... 219/630
5,990,465 A * 11/1999 Nakaoka et al. ..... 219/629

FOREIGN PATENT DOCUMENTS

| | | | |
|---|---|---|---|
| JP | 63-210555 | * 9/1988 | ..... 219/629 |
| JP | 1-115075 | * 5/1989 | ..... 219/629 |
| JP | 2-225951 | * 9/1990 | ..... 219/628 |
| JP | 5-290960 | * 11/1993 | ..... 219/629 |
| JP | 9-178102 | 7/1997 | |
| JP | 9-178103 | 7/1997 | |

* cited by examiner

*Primary Examiner*—Philip H. Leung
(74) *Attorney, Agent, or Firm*—Ostrolenk, Faber, Gerb & Soffen, LLP

(57) ABSTRACT

A fluid heating apparatus is provided which comprises a heat-generating bent tube formed of an electrically conductive material in a tubular configuration and having opposite ends connected in communication to piping through which fluid to be heated is passed, a coil provided outside the heat-generating bent tube and wound to surround the heat-generating bent tube, and a power supply unit for feeding a high-frequency current through the coil. The fluid heating apparatus suppresses the generation of particles in the path of the fluid and may be used to heat gas or liquid in an apparatus for processing semiconductor substrates and flat panel substrates.

8 Claims, 2 Drawing Sheets

FLUID HEATING APPARATUS

BACKGROUND OF THE INVENTION

1. Field of the Invention

The present invention relates to a fluid heating apparatus, more particularly an electromagnetic induction heating type fluid heating apparatus, for heating various types of fluid, such as gas and liquid, to be supplied through piping to a substrate processing section in a substrate processing apparatus which performs required processes upon substrates including semiconductor substrates and substrates for flat panel display.

2. Description of the Background Art

For a substrate processing apparatus, e.g. a reduced-pressure drying apparatus for substrates, it is necessary to heat alcohol vapor, e.g. isopropyl alcohol (IPA) vapor, up to a predetermined temperature to supply the vapor through piping into a chamber in which a substrate is contained under an atmospheric pressure. To heat the IPA vapor, an apparatus has been generally used which comprises a resistance heater on an outer peripheral surface of the piping made of stainless steel or the like and which heats the piping by heat transfer from the resistance heater to indirectly heat the IPA vapor flowing through the piping. Recently, an attempt has been made to heat the fluid flowing through the piping by the use of electromagnetic induction.

FIG. 2 is a schematic vertical sectional view of an apparatus for heating fluid by the use of electromagnetic induction. The fluid heating apparatus of FIG. 2 comprises: a heater case 40 interposed in piping (not shown) through which fluid to be heated is passed; a coil 42 wound about part of an outer peripheral surface of the heater case 40; a power supply unit (not shown) for feeding a high-frequency current through the coil 42; and a heating element 44 disposed inside the heater case 40.

The heater case 40 comprises: a cylindrical part 46 made of a non-magnetic material such as fluororesin; an entrance closing plate 48 having a fluid inlet 50 connected in communication to the piping through which the fluid is passed and a packing 52 for closing a first opening surface of the cylindrical part 46; and an exit closing plate 54 having a fluid outlet 56 connected in communication to the piping through which the heated fluid is fed out and a packing 60 for closing a second opening surface of the cylindrical part 46. Thus, the heater case 40 has an enclosed structure.

The heating element 44, the structure of which is not specifically illustrated, typically comprises a plurality of regularly arranged thin plates, e.g. corrugated plates, made of an electrically conductive material such as ferritic stainless steel so that the fluid flows through the spaces between the thin plates. A temperature sensor 62 includes a temperature sensing element, e.g. a thermocouple 64, inserted in the heater case 40 and disposed downstream from and adjacent to the heating element 44. The temperature sensor 62 measures the temperature of the heating element 44. The heater case 40 is also provided with a temperature sensor 66 for measuring the temperature of the fluid flowing out of the heater case 40. The temperature sensor 66 includes a temperature sensing element, e.g. a thermocouple 68, inserted in the heater case 40 and disposed near the outlet thereof. The temperature sensors 62 and 66 output respective temperature detection signals to a controller not shown. The controller is connected to the power supply unit and an alarm (both not shown).

In the fluid heating apparatus shown in FIG. 2, when the power supply unit feeds the high-frequency current through the coil 42, a magnetic flux is developed to induce eddy currents in the respective thin plates of the heating element 44 in the heater case 40, thereby evolving Joule heat in the thin plates because of the specific resistance of the material of the thin plates, which results in heat generation from the heating element 44. The cylindrical part 46 of the heater case 40, which is made of a non-magnetic material, does not generate heat in itself. The heat generated by the heating element 44 is transferred and applied to the fluid flowed from the piping through the fluid inlet 50 into the heater case 40 during the passage of the fluid through the position of the heating element 44. The fluid heated to a raised temperature flows out of the heater case 40 through the fluid outlet 56 into the piping. In this process, the controller outputs a control signal to the power supply unit, based on the fluid temperature detection signal detected by the temperature sensor 66, to control the temperature of the fluid flowing out of the heater case 40 to reach a target temperature. The controller also compares the temperature near the heating element 44 which is detected by the temperature sensor 62 with a preset warning temperature. When the temperature detected by the temperature sensor 62 exceeds the warning temperature, the controller outputs a signal to the alarm to activate the alarm, and outputs a signal to the power supply unit to control the power supply unit to shut off the supply of electric power from the power supply unit to the coil 42 or weaken the output to the coil 42.

Unfortunately, the conventional fluid heating apparatus as shown in FIG. 2 presents problems to be described below and therefore is not used as a fluid heater for the apparatuses for processing the semiconductor substrates and the flat panel substrates. The conventional fluid heating apparatus comprises the heating element 44 including the plurality of regularly arranged thin plates, e.g. corrugated plates, for the purpose of increasing the heat transfer area of the heating element 44. This results in a complicated structure of the heating element 44 and large amounts of dead space, making it difficult to carry out sufficient initial cleaning of the heating element 44. Further, the thin plates of the heating element 44 are thermally expanded into sliding contact with each other during the heat generation from the heating element 44 or are vibrated under the influence of flow of the fluid, particularly gas, passing through the position of the heating element 44. As a result, a large number of particles are produced by the heating element 44.

Additionally, the heating element 44 must be incorporated into the heater case 40 which is enclosed, with the fluid inlet 50 and the fluid outlet 56 connected in communication to the piping, and which has the coil-wound part made of a non-magnetic material. Thus, the heater case 40 has a complicated structure including flanged parts and the like, which leads to a large number of locations in which contaminants such as particles are deposited. As a result, once the inside of the heater case 40 is contaminated by the particles or the like, it is impossible to easily remove the particles. Therefore, the conventional fluid heating apparatus is disadvantageous in being incapable of suppressing the generation of the particles.

Furthermore, the conventional fluid heating apparatus has a complicated structure such that the heating element 44 including the plurality of thin plates, e.g. corrugated plates, is incorporated in the heater case 40. Such a complicated structure causes the flow of fluid passing through the heater case 40 to stay at some locations to prevent the uniform heat exchange of the entire heating element 44 with the fluid. As a result, the heating element 44 is partly overheated to melt, thereby suffering damages, or is reduced in heat exchange efficiency. Thus, the conventional fluid heating apparatus is not capable of heating the fluid as desired to have the heat transfer area greater than necessary, resulting in increased costs.

Even if an attempt is made to monitor the temperature of the heating element 44 which reaches the highest temperature in order to ensure an explosion-proof property, it is structurally difficult for the conventional fluid heating apparatus to place the thermocouple 64 of the temperature sensor 62 in contact with the heating element 44. Hence, the temperature sensor 62 measures the temperature near the heating element 44. It is therefore difficult to correctly monitor the temperature of the heating element 44. If the thermocouple 64 were placed in contact with the heating element 44 to measure the temperature of the heating element 44, the vibration of the heating element 44 would hinder the thermocouple 64 from making a correct measurement or generate particles to contaminate the fluid. Thus, when heating the flammable fluid such as IPA, the conventional fluid heating apparatus finds difficulties in ensuring the explosion-proof property without contamination of the fluid.

SUMMARY OF THE INVENTION

The present invention is intended for a fluid heating apparatus interposed in piping through which fluid to be heated is passed for heating the fluid by using electromagnetic induction.

According to the present invention, the fluid heating apparatus comprises: a heat-generating bent tube formed of an electrically conductive material in a tubular configuration and having opposite ends connected in communication to the piping through which the fluid is passed; a coil provided outside the heat-generating bent tube and wound to surround the heat-generating bent tube; and a power supply unit for feeding a high-frequency current through the coil.

In the fluid heating apparatus according to the present invention, when the power supply unit feeds the high-frequency current through the coil, a magnetic flux is develop to induce an eddy current in the heat-generating bent tube disposed inside the coil and lying within the magnetic flux. Thus, Joule heat is evolved in the heat-generating bent tube because of the specific resistance of the electrically conductive material of the heat-generating bent tube, which results in heat generation from the heat-generating bent tube. When the fluid having flowed through the piping enters the heat-generating bent tube heated to a raised temperature, the fluid is directly heated by the heat-generating bent tube while passing through the inside of the heat-generating bent tube. Then, the fluid heated to a raised temperature flows out of the heat-generating bent tube into the piping.

The heat-generating bent tube which is merely of a tubular configuration allows sufficient initial cleaning of the inner surface of the heat-generating bent tube for contact with the fluid. The heat-generating bent tube is merely a single tube which has no locations which cause particles to be generated in the path of the fluid and has a few locations in which contaminants such as particles are deposited. Therefore, few particles are generated in the path of the fluid in the fluid heating apparatus according to the present invention. Additionally, since the fluid flows merely through the tubular heat-generating bent tube, the heat-generating bent tube exchanges heat throughout its entire area with the fluid uniformly. Thus, the heat-generating bent tube has no overheated portion. Moreover, there is no reduction in efficiency of heat exchange between the heat-generating bent tube and the fluid.

Preferably, in the fluid heating apparatus, the heat-generating bent tube is of a helical configuration; the coil is provided in coaxial relation with the heat-generating bent tube; and the opposite ends of the heat-generating bent tube are electrically connected to each other by an electrically conductive member.

In this fluid heating apparatus, the heat-generating bent tube which is helical (coiled) in coaxial relation with the coil produces an induced electromotive force when the high-frequency current flows through the coil. Then, current flows through a closed circuit formed by the coiled tube and the electrically conductive member since the opposite ends of the coiled tube are connected to each other by the electrically conductive member. Consequently, in the heat-generating bent tube is evolved Joule heat resulting from the current flowing through the tube because of the specific resistance of the electrically conductive material of the tube, in addition to Joule heat resulting from the eddy current. Thus, the efficiency of heat generation from the heat-generating bent tube with respect to the high-frequency current fed through the coil is increased. Therefore, the fluid heating apparatus can heat the fluid more effectively. Moreover, although voltage is developed by the induced electromotive force in the coiled tube, the opposite ends of the coiled tube are short-circuited to each other. Thus, direct contact of a tube temperature sensor with the surface of the heat-generating bent tube for measurement of the temperature of the heat-generating bent tube does not destroy the tube temperature sensor.

Preferably, the fluid heating apparatus further comprises: a tube temperature sensor for detecting the temperature of the heat-generating bent tube; and a controller for effecting predetermined control based on a temperature detection signal from the tube temperature sensor.

In this fluid heating apparatus, the tube temperature sensor detects the temperature of the heat-generating bent tube, and the controller effects required control including, for example, activating an alarm or shutting off the supply of electric power from the power supply unit to the coil, based on the temperature detection signal. Unlike the conventional fluid heating apparatus in which temperature near the heating element is measured, the fluid heating apparatus according to the present invention employs the tube temperature sensor to detect the temperature of the heat-generating bent tube itself, for example, by placing a temperature sensing element, e.g. a thermocouple, in direct contact with the outer peripheral surface of the heat-generating bent tube. The temperature of the fluid flowing through the heat-generating bent tube is always lower than the temperature of the heat-generating bent tube which is detected by the tube temperature sensor. This ensures the temperature control of the fluid, e.g. IPA vapor, below its ignition point.

It is therefore an object of the present invention to provide a fluid heating apparatus for use in heating gas and liquid in an apparatus for processing semiconductor substrates and flat panel substrates, which can suppress the generation of particles in a path of fluid to be heated, which is simple in construction without danger of damages to a heating element in an overheated portion, and which can prevent the reduction in efficiency of heat exchange between the heating element and the fluid to achieve heating of the fluid as desired.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention will now be described with reference to FIG. 1.

Figure 1:
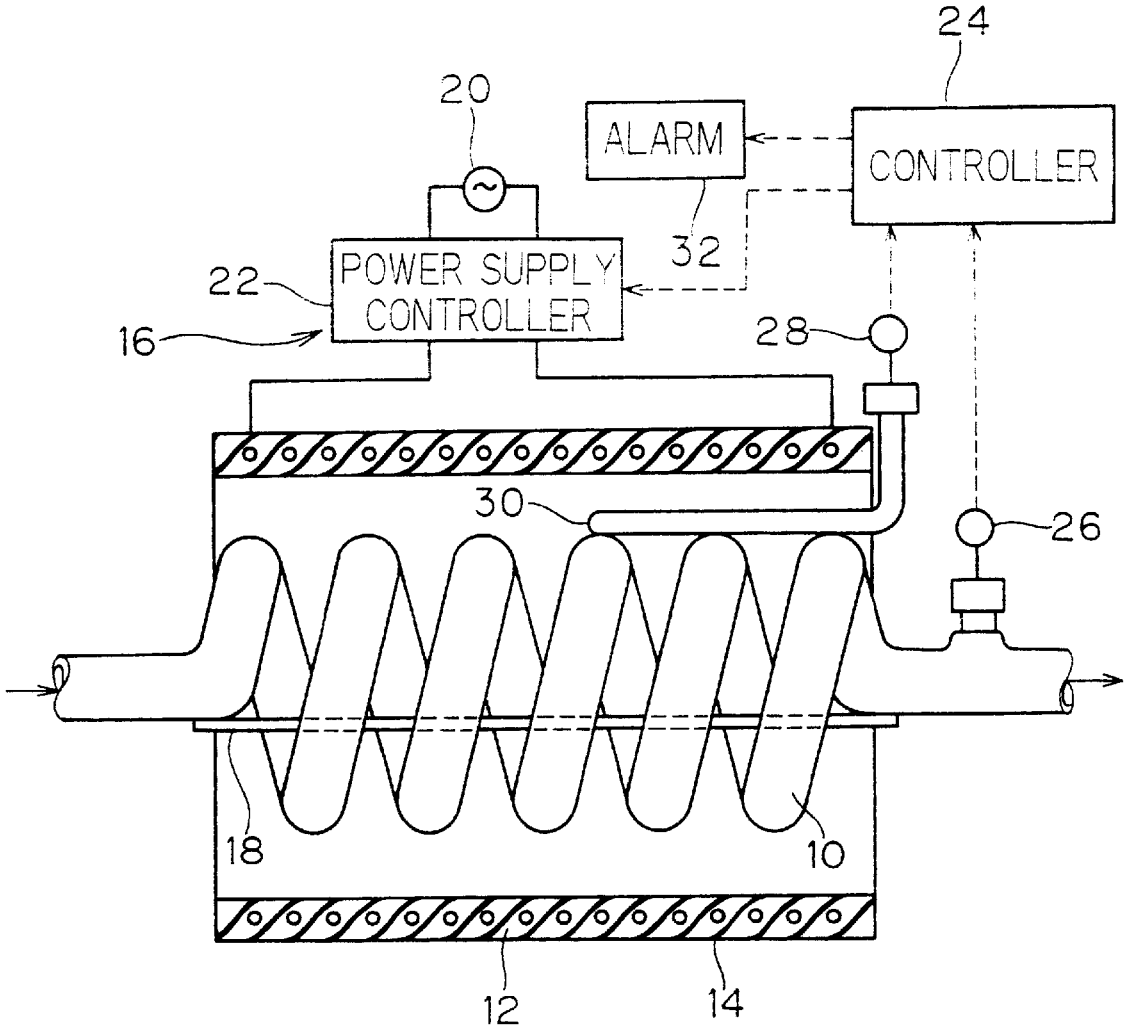
FIG. 1 is a vertical sectional view of principal parts of a fluid heating apparatus according to a preferred embodiment of the present invention.
Figure 2:
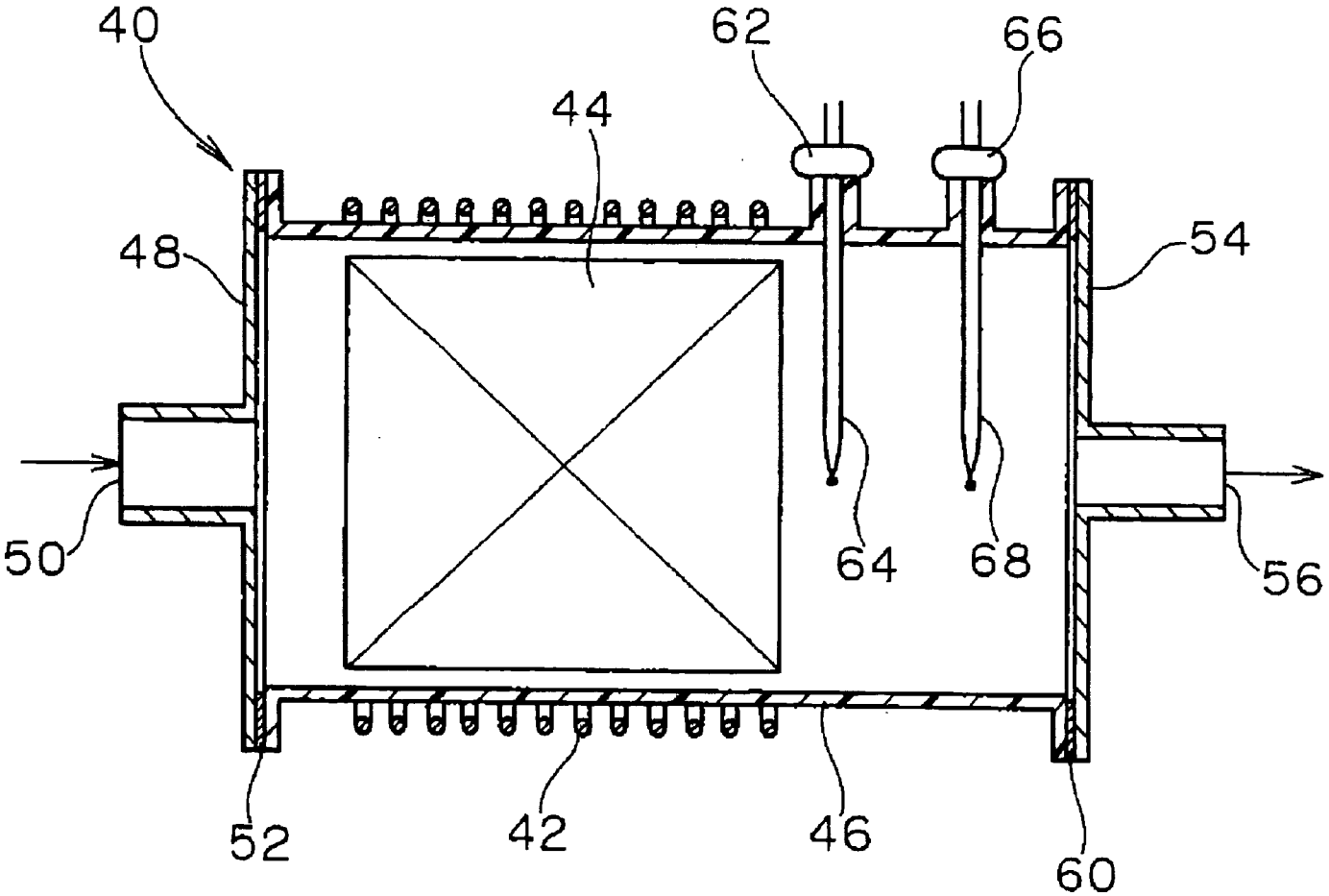
FIG.2 (Prior Art)
FIG. 2 is a schematic vertical sectional view of an apparatus for heating fluid by the use of electromagnetic induction.

FIG. 1 is a vertical sectional view of principal parts of a fluid heating apparatus according to a preferred embodiment of the present invention. The fluid heating apparatus of FIG. 1 is interposed in piping for supplying gas such as IPA vapor or liquid such as pure water and chemical solution to a substrate processing apparatus which performs required processes on substrates including semiconductor substrates and flat panel substrates, although not shown. The fluid heating apparatus of FIG. 1 comprises: a heat-generating bent tube 10 having opposed ends connected in communication to the piping; a tubular covering 12 of cylindrical configuration made of an electrically insulating material and disposed outside the heat-generating bent tube 10 so as to surround the heat-generating bent tube 10; a coil 14 buried in the tubular covering 12 so as to wound around the heat-generating bent tube 10; and a power supply unit 16 for feeding a high-frequency current through the coil 14.

The heat-generating bent tube 10 is made of an electrically conductive material, e.g. stainless steel. The heat-generating bent tube 10 has a helical heating section. Ferritic stainless steel which is a corrosion-resistant material and suitable for induction heating is used as the stainless steel material of the heat-generating bent tube 10. Austenitic stainless steel such as JIS (Japanese Industrial Standards) defined SUS316L (18Cr—12Ni—2.5Mo—N-low C) and JIS-defined SUS304 (18Cr—9Ni) may be also used since heating by means of current flowing through a closed circuit, in addition to the induction heating, acts upon the heat-generating bent tube 10. The stainless steel tube to be used is subjected to an electrolytic polishing process or may be subjected to a bright annealing process. The tube 10 is bent into a helical configuration in a cleanroom or the like so as not to be contaminated. Alternatively, a stainless steel tube bent in a general workplace and then subjected to a chemical cleaning process or a stainless steel tube bent in a cleanroom or the like so as not to be contaminated and then subjected to a chemical cleaning process may be used as the heat-generating bent tube 10. Opposite ends of a helical tube section serving as the heating section of the heat-generating bent tube 10 are welded respectively to opposite ends of a shorting stick 18 made of an electrically conductive material, and thus are electrically connected to each other by the shorting stick 18.

The coil 14 is wound in coaxial relation with the heat-generating bent tube 10. The power supply unit 16 electrically connected to the coil 14 comprises a high-frequency power supply 20 and a power supply controller 22. The power supply controller 22 is connected to a controller 24. The fluid heating apparatus further comprises a temperature sensor 26 including a temperature sensing element, such as a thermocouple, a temperature-measuring resistive device or a radiation thermometer, having a detection end inserted in a flow passage of the heat-generating bent tube 10 on its outlet side. The temperature sensor 26 detects the temperature of the fluid flowing out of the heat-generating bent tube 10. The fluid heating apparatus further comprises a temperature sensor 28 fixedly provided so that a detection end of a temperature sensing element 30, such as a thermocouple or a temperature-measuring resistive element, of the temperature sensor 28 is in direct contact with an outer peripheral surface of the heat-generating bent tube 10. The temperature sensor 28 detects the temperature of the heat-generating bent tube 10 in contacting fashion. Temperature detection signals outputted from the respective temperature sensors 26 and 28 are transmitted to the controller 24. The controller 24 is connected to an alarm 32, in addition to the power supply controller 22.

With the above-mentioned arrangement of the fluid heating apparatus, the power supply unit 16 is driven to feed the high-frequency current through the coil 14 when heating the fluid, e.g. IPA vapor, to be fed through the piping to the substrate processing apparatus. The high-frequency current fed through the coil 14 develops a magnetic flux to induce an eddy current in the heat-generating bent tube 10 disposed inside the coil 14 and lying within the magnetic flux. Thus, Joule heat is evolved in the heat-generating bent tube 10 because of the specific resistance of the electrically conductive material thereof, which results in heat generation from the heat-generating bent tube 10. Heat is also generated by the current flowing through the closed circuit formed by the heat-generating bent tube 10 and the shorting stick 18. When the IPA vapor having flowed through the piping enters the heat-generating bent tube 10 heated to a raised temperature, the IPA vapor is heated by heat transfer from an inner wall surface of the heat-generating bent tube 10 while passing through the inside of the heat-generating bent tube 10. Then, the IPA vapor heated to a raised temperature flows out of the heat-generating bent tube 10 into the piping.

In this process, the controller 24 makes a comparison between a preset target temperature and the fluid temperature detected by the temperature sensor 26, to output a control signal corresponding to the temperature difference therebetween to the power supply controller 22. Thus, the current fed through the coil 14 is feedback controlled so that the temperature of the fluid flowing out of the heat-generating bent tube 10 reaches the target temperature.

The controller 24 makes another comparison between a preset warning temperature and the temperature of the heat-generating bent tube 10 which is detected by the temperature sensor 28. When the temperature of the heat-generating bent tube 10 exceeds the warning temperature, the controller 24 transmits a signal to the alarm 32 to drive the alarm 32. This alerts an operator that the temperature of the heat-generating bent tube 10 is at an abnormally elevated level. Further, when the temperature of the heat-generating bent tube 10 exceeds the warning temperature, the controller 24 transmits a signal to the power supply controller 22 to shut off the supply of electric power from the high-frequency power supply 20 to the coil 14 or to weaken the output to the coil 14. Alternatively, the amount of flow of the fluid introduced into the heat-generating bent tube 10 may be temporarily increased when the temperature of the heat-generating bent tube 10 exceeds the warning temperature. The temperature of the fluid flowing through the heat-generating bent tube 10 is always lower than the temperature of the heat-generating bent tube 10 which is detected by the temperature sensor 28. Thus detecting the temperature of the heat-generating bent tube 10 itself to activate the alarm 32 or shut off the supply of electric power to the coil 14 ensures the control of the temperature of the fluid, e.g. IPA vapor, below its ignition point.

To detect the temperature of the heat-generating bent tube 10, the temperature sensing element 30 is provided on the outer peripheral surface of the heat-generating bent tube 10 in this preferred embodiment. This prevents the contamination of the fluid flowing through the heat-generating bent tube 10 even if particles are produced from the temperature sensing element 30 because of the vibration of the heat-generating bent tube 10. Additionally, fixing the temperature sensing element 30 in direct contact with the heat-generating bent tube 10 prevents the production of particles from the temperature sensing element 30 because of the vibration of the heat-generating bent tube 10.

In this fluid heating apparatus, the heat-generating bent tube 10 serving as a path of the fluid is bent to prevent contamination or is subjected to the chemical cleaning process to remove contamination, if generated in the bending process step, and is thereafter used. The tube 10, which is merely a bent stainless steel tube, is simple in construction and has no dead space in the path of the fluid. The use of the stainless steel tube subjected to the electrolytic polishing or bright annealing process allows sufficient initial cleaning of the inner surface of the tube 10 for contact with the fluid. The heat-generating bent tube 10 is merely a single tube which is free from partial sliding contact between components thereof resulting from the thermal expansion of the components during the heat generation from the tube 10 and is also free from vibrations under the influence of the flow of the fluid, particularly gas, passing through the tube 10. Unlike the conventional fluid heating apparatus having a complicated structure such that the heating element is incorporated in the case made of the non-magnetic material such as fluororesin, the fluid heating apparatus according to the present invention comprises the heat-generating bent tube 10 as the passage of the fluid which is merely a helical tube having a simple structure. Thus, the heat-generating bent tube 10 has no locations in which contaminants such as particles are deposited. Therefore, the fluid heating apparatus according to the present invention suppresses the generation of particles in the path of the fluid.

Since the fluid flows merely through the helical tube 10, the tube 10 exchanges heat throughout its entire area with the fluid uniformly. Thus, there is no danger that the heat-generating bent tube 10 is partially overheated to melt or otherwise be damaged. Furthermore, the fluid is given a swirl and flows in the form of a turbulent flow through the heat-generating bent tube 10. This precludes the reduction in efficiency of heat exchange between the tube 10 and the fluid. Therefore, the fluid heating apparatus according to the present invention is compact in size with a smaller heat transfer area, and low in costs.

In the fluid heating apparatus shown in FIG. 1, the heat-generating bent tube 10 which is coiled in coaxial relation with the coil 14 produces an induced electromotive force when the high-frequency current flows through the coil 14. Then, current flows through the closed circuit formed by the coiled tube 10 and the shorting stick 18 since the opposite ends of the coiled tube 10 are connected to each other by the electrically conductive shorting stick 18. Consequently, in the heat-generating bent tube 10 is evolved Joule heat resulting from the current flowing through the tube 10 because of the induced electromotive force, in addition to Joule heat resulting from the eddy current. Thus, the efficiency of heat generation from the tube 10 with respect to the high-frequency current fed through the coil 14 is increased. Therefore, the fluid heating apparatus shown in FIG. 1 can heat the fluid more effectively. This allows the use of JIS-defined SUS316L and JIS-defined SUS304 which are austenitic stainless steel not suitable for induction heating but highly corrosion-resistant, to achieve the fluid heating apparatus as a fluid heater for a semiconductor manufacturing apparatus which is required to keep the fluid quite free from contamination, even if slight corrosion. Moreover, although voltage is developed by the induced electromotive force in the coiled tube 10, the opposite ends of the coiled tube 10 are short-circuited to each other by the shorting stick 18. Thus, direct contact of the temperature sensing element 30 of the temperature sensor 28 with the surface of the heat-generating bent tube 10 for measurement of the temperature of the tube 10 does not destroy the temperature sensor 28.

Although the heat-generating bent tube 10 is illustrated as shaped in the helical configuration in the above preferred embodiment, the heat-generating bent tube is required only to be a stainless steel tube bent so as to ensure some heat transfer area, and may be, for example, of meandering or spiral configuration.

While the invention has been described in detail, the foregoing description is in all aspects illustrative and not restrictive. It is understood that numerous other modifications and variations can be devised without departing from the scope of the invention.

What is claimed is:

1. An inductive heat generator apparatus interposed in piping through which fluid to be heated is passed for heating the fluid by using electromagnetic induction, said apparatus comprising:

a heat-generating bent tube formed of an electrically conductive material in a tubular configuration and having opposite ends connected in communication to said piping through which the fluid is passed;

a coil provided outside said heat-generating bent tube and wound to surround said heat-generating bent tube;

a power supply unit for feeding a high-frequency current through said coil; and a tube temperature sensor provided inside said coil, for detecting the temperature of said heat-generating bent tube.

2. The apparatus according to claim 1, wherein said heat-generating bent tube is of a helical configuration;

said coil is provided in coaxial relation with said heat-generating bent tube; and said opposite ends of said heat-generating bent tube are electrically connected to each other by an electrically conductive member.

3. The apparatus according to claim 2, further comprising:

a controller for effecting predetermined control based on a temperature detection signal from said tube temperature sensor.

4. The apparatus according to claim 3, further comprising a fluid temperature sensor provided in a flow passage of said heat-generating bent tube on its outlet side for detecting the temperature of the fluid flowing out of said heat-generating bent tube, wherein said controller effects feedback control of said power supply unit so that the temperature of the fluid detected by said fluid temperature sensor reaches a present target temperature.

5. The apparatus according to claim 3, wherein said tube temperature sensor is in contact with an outer peripheral surface of said heat-generating bent tube.

6. The apparatus according to claim 5, wherein said controller controls said power supply unit to shut off said high-frequency current to be fed through said coil when the temperature of said heat-generating bent tube exceeds a present warning temperature.

7. The apparatus according to claim 2, wherein said heat-generating bent tube is made of ferritic stainless steel.

8. The apparatus according to claim 2, wherein said heat-generating bent tube is made of austenitic stainless steel.

* * * * *